US008783801B2

(12) United States Patent
Kaplan et al.

(10) Patent No.: US 8,783,801 B2
(45) Date of Patent: Jul. 22, 2014

(54) HOUSEHOLD APPLIANCE

(75) Inventors: Ergin Kaplan, Istanbul (TR); Levent Orundu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 22 days.

(21) Appl. No.: 13/063,190

(22) PCT Filed: Sep. 7, 2009

(86) PCT No.: PCT/EP2009/061561

§ 371 (c)(1),
(2), (4) Date: Mar. 9, 2011

(87) PCT Pub. No.: WO2010/029042

PCT Pub. Date: Mar. 18, 2010

(65) Prior Publication Data

US 2011/0156547 A1 Jun. 30, 2011

(30) Foreign Application Priority Data

Sep. 9, 2008 (TR) ..... A 2008 06824

(51) Int. Cl.
*A47B 96/04* (2006.01)

(52) U.S. Cl.
USPC ..... 312/405.1; 312/204

(58) Field of Classification Search
CPC . F25D 29/005; F25D 2400/18; F25D 23/028; F25D 23/02
USPC ..... 312/401, 405, 405.1, 204, 7.2, 327, 312/328, 116; 49/501, 169, 171; 62/125, 62/331
See application file for complete search history.

(56) References Cited

U.S. PATENT DOCUMENTS

| | | | | | |
|---|---|---|---|---|---|
| 4,404,813 | A * | 9/1983 | Paddock et al. | 62/127 |
| 4,635,809 | A * | 1/1987 | Bachman et al. | 220/4.21 |
| 4,840,286 | A * | 6/1989 | Heberling et al. | 220/4.02 |
| 6,101,819 | A * | 8/2000 | Onaka et al. | 62/125 |
| 6,310,767 | B1 * | 10/2001 | Spear et al. | 361/679.24 |
| 6,682,161 | B2 * | 1/2004 | Yun | 312/405 |
| 6,788,532 | B2 * | 9/2004 | Yang et al. | 361/679.33 |
| 7,260,954 | B2 * | 8/2007 | Jang et al. | 62/285 |
| 7,404,298 | B2 * | 7/2008 | Kim et al. | 62/126 |
| 7,555,910 | B2 * | 7/2009 | Oh et al. | 62/126 |
| 8,314,334 | B1 * | 11/2012 | Cleghorn et al. | 174/66 |
| 8,434,264 | B2 * | 5/2013 | Bosserdet, Jr. | 49/169 |
| 2004/0216471 | A1 * | 11/2004 | Kim et al. | 62/126 |
| 2005/0097912 | A1 * | 5/2005 | Nam et al. | 62/331 |
| 2006/0144055 | A1 * | 7/2006 | Ahn | 62/126 |

(Continued)

FOREIGN PATENT DOCUMENTS

| | | | | |
|---|---|---|---|---|
| DE | 202006011217 U1 | | 11/2007 | |
| JP | 2002039673 A | * | 2/2002 | F25D 29/00 |
| WO | 2007011178 A | | 1/2007 | |
| WO | WO 2007011178 A1 | * | 1/2007 | |
| WO | 2009080494 A | | 7/2009 | |
| WO | 2009104859 A | | 8/2009 | |

*Primary Examiner* — Darnell Jayne
*Assistant Examiner* — Hiwot Tefera
(74) *Attorney, Agent, or Firm* — Venable, Campillo, Logan & Meaney, PC

(57) ABSTRACT

A household appliance (1) that includes a cabinet (17), a door (2) mounted on the cabinet (17) and allowing access into the cabinet (17), a glass panel (4) having an inner surface (5) and a decorative outer surface (6), mounted on the door (2), and a control panel (3), enabling the user to change various parameters, adjust and/or monitor various functions of the household appliance (1).

7 Claims, 6 Drawing Sheets

(56) References Cited

U.S. PATENT DOCUMENTS

2006/0168895 A1* 8/2006 Bienick et al. ..... 49/501
2006/0179719 A1* 8/2006 Christie ..... 49/169
2006/0232723 A1* 10/2006 Maruta ..... 349/58
2007/0096606 A1* 5/2007 Ryu ..... 312/7.2
2008/0238269 A1* 10/2008 Yamanaka ..... 312/7.2
2009/0261694 A1* 10/2009 Yamanaka ..... 312/7.2
2010/0287975 A1* 11/2010 Lim ..... 62/449

* cited by examiner

HOUSEHOLD APPLIANCE

FIELD

The present invention relates to a household appliance comprising a door whereon a decorative panel is mounted.

Nowadays household appliances, particularly the doors of refrigerators are clad by glass, mirror etc. decorative panels for the purpose of giving an aesthetic appearance. However, various hardships are encountered particularly in mounting the control panels on glass panels, such that the necessity of performing the mechanical operations delicately on a material like glass increases the labor and unit costs.

In the state of the art International Patent Application no WO2007011178, the explanation is given for a display unit, which is mounted on a door comprising a decorative panel. In this embodiment, the display unit is secured temporarily at the rear of the glass panel by an adhesive and afterwards the glass panel is mounted on the door together with the display unit. The display unit is seated in a housing on the door.

In this embodiment, since the display unit is temporarily mounted on the glass panel, various mechanisms should be used for keeping the display unit stable in the housing. Moreover, the problem of keeping a precise distance between the glass panel and the control panel in touch screen panel applications is also confronted in this embodiment.

The aim of the present invention is the realization of a household appliance comprising a control panel that is easily mounted on a door having a glass panel thereon.

SUMMARY

The household appliance realized in order to attain the aim of the present invention, explicated in the first claim and the respective claims thereof, comprises a frame secured on the glass panel by adhesion and a cover whereon the control panel is mounted and which is secured on the frame thereafter.

Accordingly, the frame and the cover provide the control panel to be kept between the glass panel and the door at a certain distance determined by the producer. This maintains the easy assembly of the touch screen control panels on the door. Moreover, since the control panel is secured on the glass panel by means of the frame and the cover, there is no need for using a fastening element or applying any mechanical operations on the door.

The cover, wherein the control panel is secured, can be mounted on the frame, which is adhered on the glass panel permanently, by tight fitting or snap fitting fastening methods.

The household appliance furthermore comprises two pins disposed oppositely on the opposite walls of the cover and two pin sockets situated oppositely on the opposite sides of the frame. The cover is mounted on the frame such that the pins are seated in the pin sockets. Thus, the cover is pivotably mounted on the frame to be openable and closable and providing maintenance service for the control panel mounted inside the cover becomes easy.

By means of the present invention, on a household appliance glass panel door, the control panel can be mounted on the door without the necessity of performing any mechanical operations on the glass panel and the door except adhesion. Particularly in the assembly of touch screen control panels on the door, the distance to be kept between the glass panel and the touch screen can be adjusted more precisely by the present invention and the control panel can be mounted on the door without forming a housing for containing the control panel.

By means of the present invention, furthermore savings is provided in labor and time and the glass is prevented from damage since a mechanical operation is not performed on a fragile surface such as glass.

BRIEF DESCRIPTION OF THE DRAWINGS

A household appliance realized in order to attain the aim of the present invention is illustrated in the attached figures, where.

DETAILED DESCRIPTION

Figure 1:
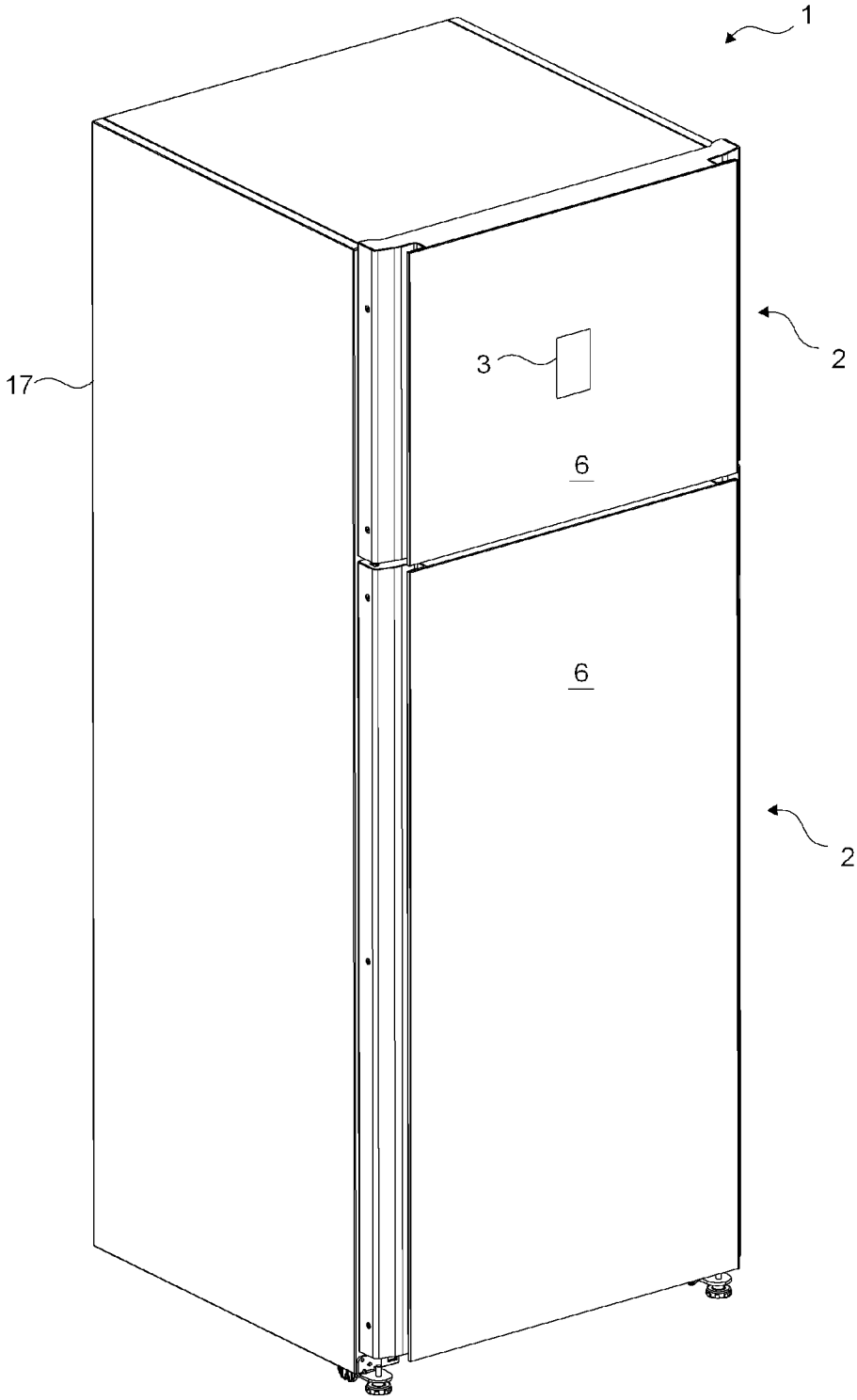
FIG. 1—is the perspective view of a household appliance.

The elements illustrated in the figures are numbered as follows:

1. Household appliance
2. Door
3. Control panel
4. Glass panel
5. Inner surface
6. Outer surface
7. Frame
8. Cover
9. Locking element
10. Protuberance
11. Recess
12. Sliding surface
13. Pin
14. Pin socket
15. Connection member
16. Retainer
17. Cabinet The household appliance (1) of the present invention comprises a cabinet (17), a door (2) mounted on the cabinet (17) and allowing access into the cabinet (17), a glass panel (4) having an inner surface (5) and a decorative outer surface (6), mounted on the door (2), a control panel (3) disposed on the glass panel (4), enabling the user to change various parameters, adjust and/or monitor various functions of the household appliance (1) (FIG. 1).

Figure 2:
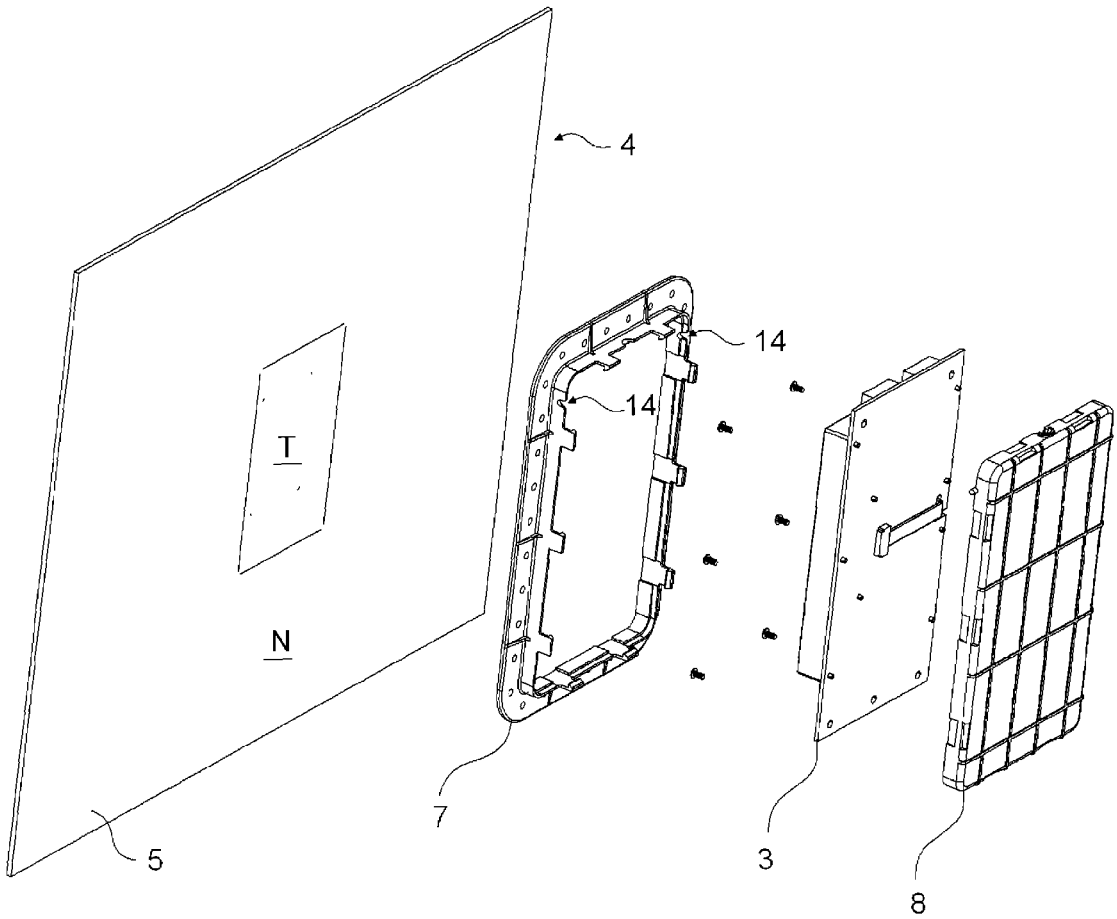
FIG. 2—is the exploded view of a glass panel, a frame, a control panel and a cover.

The household appliance (1) comprises,

- a frame (7) adhered on the inner surface (5) of the glass panel (4) and
- a box shaped cover (8) whereon the control panel (3) is mounted and which supports the control panel (3), keeping the control panel (3) between itself and the inner surface (5) of the glass panel (4) by being secured on the frame (7) (FIG. 2).

The frame (7) and the cover (8) provide the control panel (3) to be kept between the glass panel (4) and the door (2) at a certain distance determined by the producer. Thus, the assembly of the touch screen control panels (3) can be easily performed on the door (2). Moreover, there's no need for using any fastening elements on the door (2) or performing any mechanical operations on the door (2) since the control panel (3) is secured on the glass panel (4) by means of the frame (7) and the cover (8). The frame (7) and the cover (8) remain between the glass panel (4) and the door (2).

The outer surface (6) of the glass panel (4) can be transparent or semi-transparent glass or can also be a decorative surface like a mirror. Furthermore the glass panel (4) comprises a transparent surface (T) and a nontransparent surface (N) that surrounds that surface (T) coinciding with each other on the inner surface (5) and the outer surface (6). Accordingly, a better esthetic external appearance is provided for the household appliance (1) by enabling the user to view only the portions of the control panel (3) for monitoring and controlling through the glass panel (4) and keeping the other portions out of sight.

The frame (7) is preferably configured with a quadrangular shape and surrounds the transparent surface (T) on the glass panel (4).

The cover (8) is configured as a hollow box, with only one surface open and which is mounted on the frame (7).

The household appliance (1) comprises more than one locking element (9) disposed oppositely on the frame (7) and the cover (8) for mounting the frame and the cover (8) unto each other. The frame (7) and the cover (8) can be secured to each other by snap-fitting or tight fitting.

The household appliance (1) furthermore comprises a connection member (15) disposed on the cover (8) that provides the electric connection for the control panel (3).

In the preferred embodiment of the present invention, the control panel (3) comprises one or more buttons for the user to change various parameters and to regulate certain functions of the household appliance (1) and one or more displays so that the user can follow the adjustments done (not shown in the figures).

Figure 3:
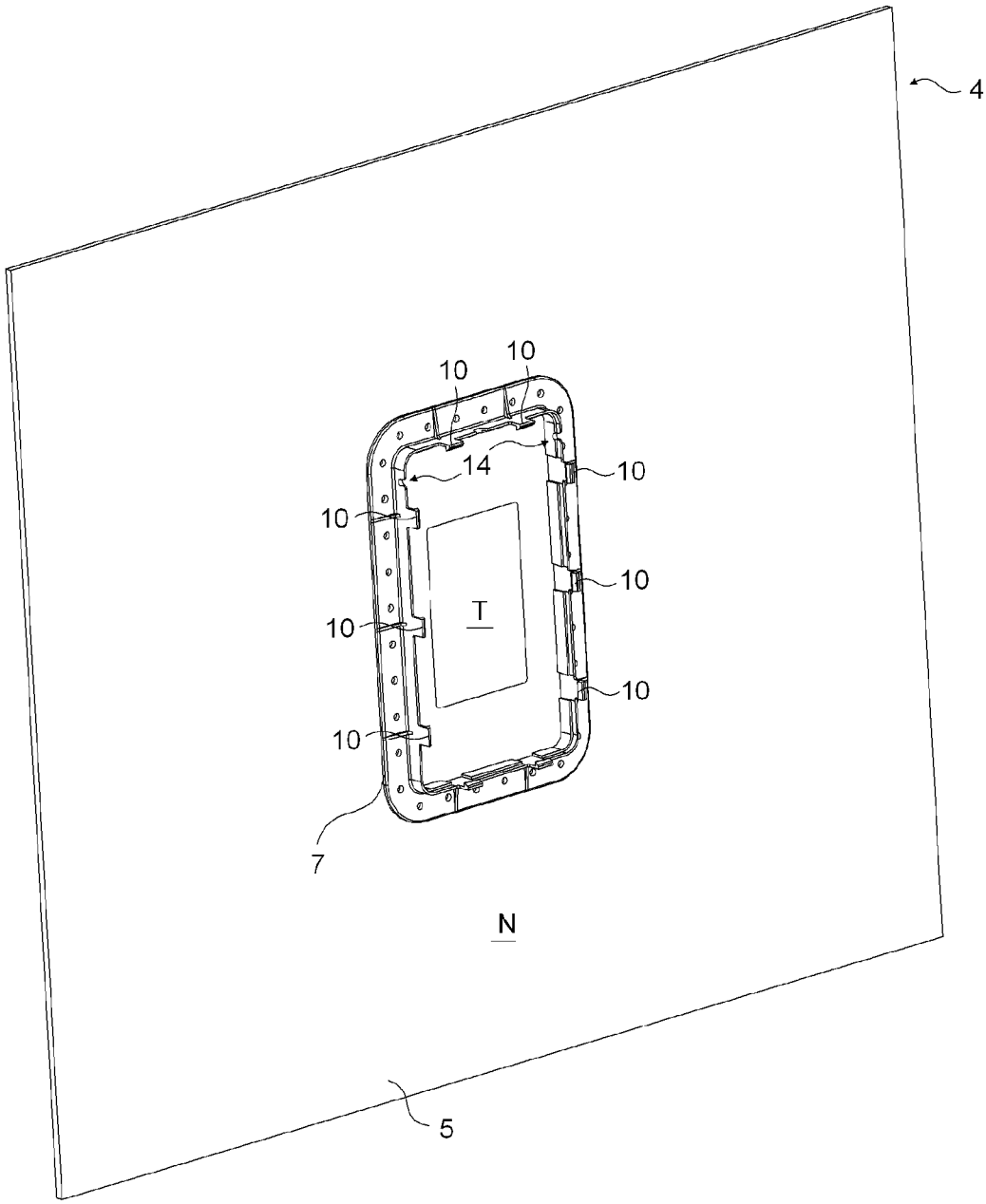
FIG. 3—is the perspective view of a frame mounted on a glass panel.
Figure 4:
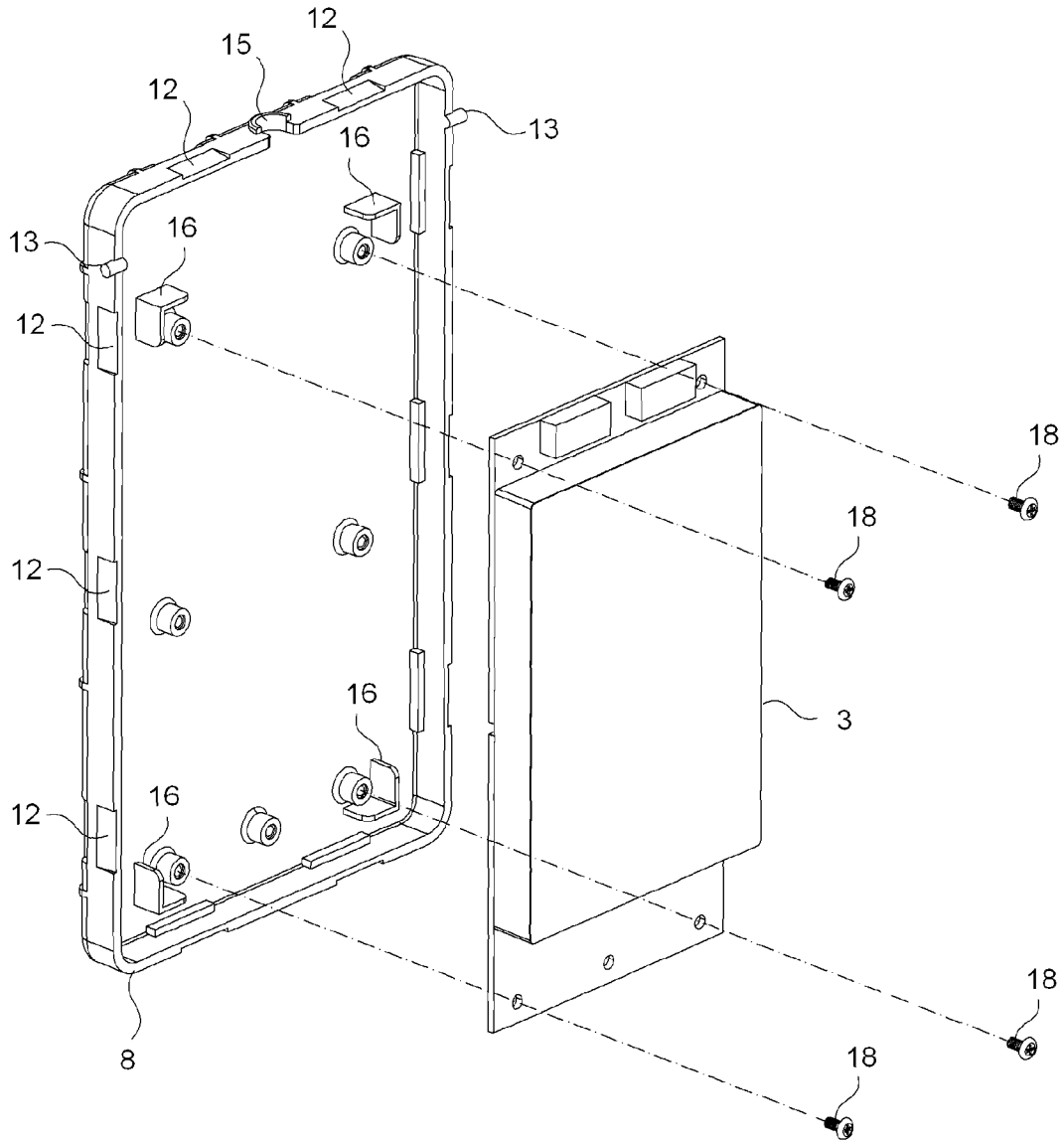
FIG. 4—is the exploded view of a cover and a control panel.
Figure 5:
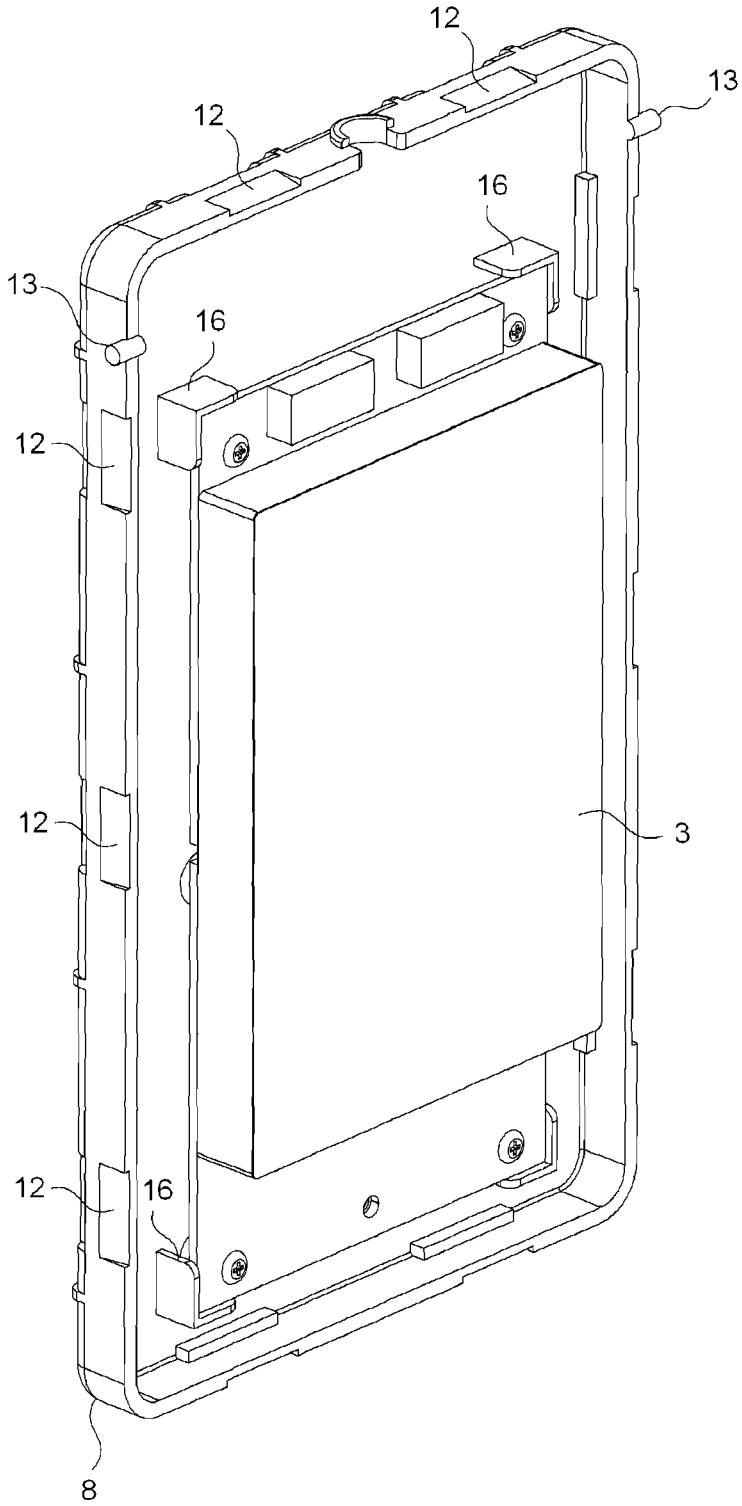
FIG. 5—is the perspective view of a control panel mounted on a cover.
Figure 6:
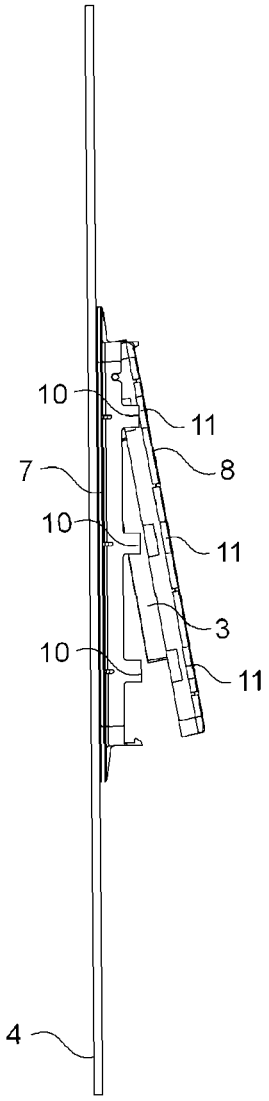
FIG. 6—is the sideways view of the control panel while being mounted on the cover and the frame.
Figure 7:
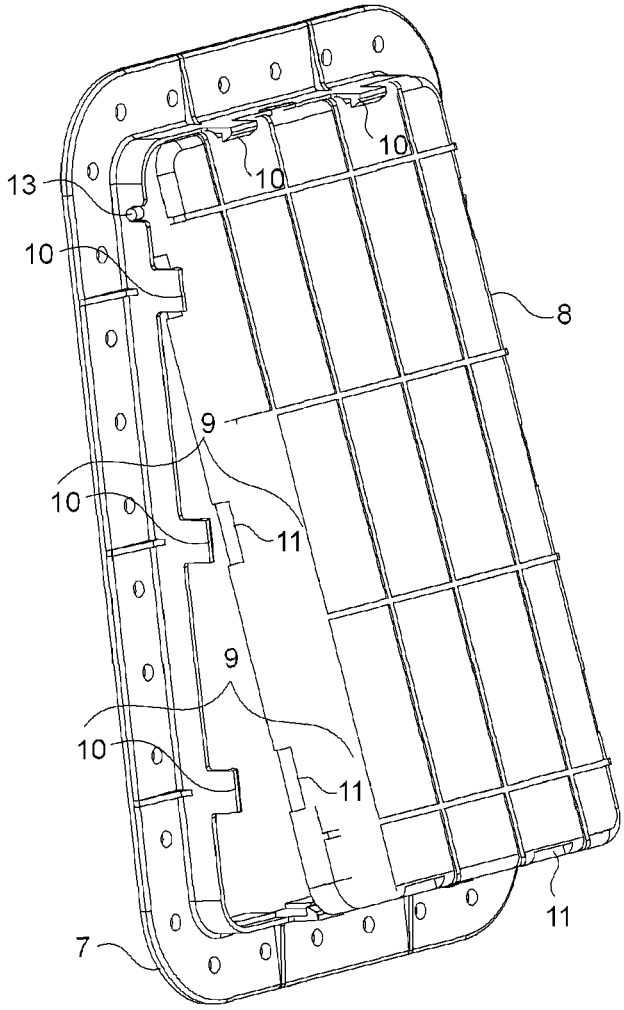
FIG. 7—is the perspective view of the control panel while being mounted on the cover and the frame.

The assembly of the control panel (3) on the glass panel (4) is performed in the following manner: The frame (7) is adhered on the inner surface (5) of the glass panel (4) such that the transparent surface (T) on the inner surface (5) of the glass panel (4) is surrounded (FIG. 3). Thus, the frame (7) is mounted on the glass panel (4) without using any fastening elements except the adhesive. Similarly, the control panel (3) is secured on the base of the cover (8) by using various fastening methods. When the control panel (3) is secured on the cover (8), the displays and/or the buttons on the control panel (3) face the open surface of the cover (8) (FIG. 4 and FIG. 5). The cover (8) whereon the control panel (3) is secured, is fastened on the frame (7) which is secured on the glass panel (4) by means of locking elements (9) and the control panel (3) is mounted on the glass panel (4) by means of the frame (7) and the cover (8). Afterwards, the control panel (3) is connected to the electric cables coming from the door (2) by means of the connection member (15) on the cover (8) and when the glass panel (4) is mounted on the door (2), the assembly of the control panel (3) on the glass panel (4) is completed (FIG. 6 and FIG. 7).

When the glass panel (4) is dismounted from the door (2), maintenance service can be provided for the control panel (3) inside the cover (8) by only disassembling the cover (8) from the frame (7) and the malfunctioning control panel (3) can be replaced with another one by means of mounting the cover (8) affixed with the locking elements (9) on the frame (7) which is permanently secured on the glass panel (4) by adhesion.

In an embodiment of the present invention, the locking element (9) comprises clips shaped protuberances (10) arranged on the frame (7) with spaces therebetween and recesses (11) formed on the side wall of the cover (8) with spaces therebetween to coincide with the protuberances (10), wherein the clips are seated to be locked.

In this embodiment of the present invention, the household appliance (1) furthermore comprises a sliding surface (12), on the side wall, just under each recess (11) whereon the protuberance (10) slides, which stretches the protuberance (10) so that it is seated in the recess (11). In this embodiment of the present invention, while the cover (8) is mounted on the frame (7), the protuberances (10) on the frame (7) stretch by sliding on the sliding surface (12) and are seated in the recess (11) upon reaching the recess (11) at the end of the sliding surface (12) by stretching backwards. Thus, the cover (8) and the frame (7) are secured to each other.

The household appliance (1) furthermore comprises two pins (13) situated on two opposite sides of the cover (8) for pivotably securing the cover (8) on the frame (7) from one side and two pin sockets (14) on two opposite sides of the frame (7) wherein these pins (13) are seated. Accordingly, the cover (8) can be opened and closed by rotating around the pins (13). Thus, maintenance service can be provided more easily for the control panel (3) inside the cover (8).

In another embodiment of the present invention, the household appliance (1) comprises more than one retainer (16) situated on the base of the cover (8), with the control panel (3) disposed therebetween, preventing the horizontal and vertical movements of the control panel (3) by compressing the control panel (3) from the sides.

By means of the present invention, the control panel (3) can be mounted on the glass panel (4) door (2) of a household appliance (1) without requiring to perform any mechanical operations on the glass panel (4) and the door (2) besides adhesion. Particularly, in the assembly of touch screen control panels (3) on the door (2), the distance to be kept between the glass panel (4) and the touch screen can be adjusted more precisely with the present invention and the control panel (3) can be mounted on the door (2) without forming a housing wherein the control panel (3) will be seated. By means of the present invention, furthermore savings is provided in labor and time and the glass is prevented from damage since a mechanical operation is not performed on a fragile surface such as glass.

It is to be understood that the present invention is not limited to the embodiments disclosed above and an expert in the technique can easily introduce different embodiments of the present invention. These should be considered within the scope of the protection postulated by the claims of the present invention.

The invention claimed is:

1. A household appliance (1) comprising: a cabinet (17), a door (2) mounted on the cabinet (17) and allowing access into the cabinet (17), a glass panel (4) mounted on the door (2) and having an inner surface (5) and a decorative outer surface (6), a frame (7) adhered on the inner surface (5) of the glass panel (4) and a control panel mounted to a box shaped cover (8) and secured to the frame (7) so the control panel (3) is kept between the box shaped cover (8) and the inner surface (5) of the glass panel (4) wherein the control panel enables various parameters to be changed and adjust and/or monitor various functions of the household appliance; wherein a plurality of locking elements (9) are disposed oppositely on the frame (7) and the cover (8) for mounting the frame (7) and the cover (8) unto each other; wherein the plurality of locking elements (9) comprising clip shaped protuberances (10) arranged on the frame (7) with spaces therebetween and recesses (11) formed on a side wall of the cover (8) with spaces therebetween to coincide with the protuberances (10); further comprising a sliding surface (12) on the side wall, under each recess (11), the respective protuberance is slid on the sliding surface and seated in the recess; and further comprising two pins (13) situated on two opposite sides of the cover (8) for pivotably securing the cover (8) on the frame (7) from one side and two pin sockets (14) on two opposite sides of the frame (7), wherein the two pins (13) are seated in the pin sockets.

2. The household appliance (1) as in claim 1 further comprising a plurality of retainers (16) situated on a base of the cover (8), with the control panel (3) disposed therebetween, preventing the horizontal and vertical movements of the control panel (3) by compressing the control panel (3) from the sides.

3. The household appliance (1) as in claim 2 further comprising a connection member (15) disposed on the cover (8) that provides an electric connection for the control panel (3).

4. The household appliance (1) as in claim 1, wherein the cover (8) is mounted on the frame (7) such that an open surface thereof faces the inner surface (5).

5. The household appliance (1) as in claim 1, wherein the glass panel (4) further comprises a transparent surface (T) and a nontransparent surface (N) that surrounds the transparent surface (T), the transparent and nontransparent surfaces are adapted to coincide with each other on the inner surface (5) and the outer surface (6).

6. The household appliance (1) as in claim 5, wherein the transparent surface (T) is surrounded by the frame (7) and the frame (7) is adhered on the inner surface (5).

7. The household appliance (1) as in claim 1, wherein the plurality of locking elements (9) are adapted to maintain the frame (7) and the cover (8) to be mounted to each other by tight fitting.

* * * * *